United States Patent [19]

Guyot

[11] Patent Number: 4,701,792

[45] Date of Patent: Oct. 20, 1987

[54] PICTURE TUBE WITH VIDEO OUTPUT, PICTURE TAKING SYSTEM UTILIZING SUCH TUBE AND OPERATING PROCESS OF SAID TUBE

[75] Inventor: Lucien Guyot, Paris, France

[73] Assignee: Thomson-CSF, Paris, France

[21] Appl. No.: 774,037

[22] Filed: Sep. 9, 1985

[30] Foreign Application Priority Data

Sep. 7, 1984 [FR] France ..... 84 13815

[51] Int. Cl.[4] ..... G03C 5/17

[52] U.S. Cl. ..... 358/111; 250/213 VT; 250/213; 250/213 R

[58] Field of Search ..... 358/111, 213, 110, 209; 250/315.3, 213 VT; 378/99

[56] References Cited

U.S. PATENT DOCUMENTS

| | | | |
|---|---|---|---|
| 2,747,132 | 5/1956 | Sheldon | 315/11 |
| 3,716,747 | 2/1973 | Patel | 315/10 |
| 3,975,637 | 8/1976 | Ikedo et al. | 378/99 |
| 4,208,577 | 6/1980 | Wang | 250/213 VT |
| 4,246,607 | 1/1981 | Vijverberg | 358/111 |
| 4,268,750 | 5/1981 | Cowart | 358/111 |
| 4,471,378 | 9/1984 | Ng | 358/111 |
| 4,521,808 | 6/1985 | Ong et al. | 358/111 |
| 4,597,017 | 6/1986 | Johnson et al. | 358/111 |

FOREIGN PATENT DOCUMENTS

| | | |
|---|---|---|
| 1137425 | 1/1957 | France . |
| 1277725 | 10/1961 | France . |
| 2153012 | 4/1973 | France . |
| 212635 | 7/1974 | France . |

*Primary Examiner*—Gene Z. Rubinson
*Assistant Examiner*—Stephen Brinich
*Attorney, Agent, or Firm*—Roland Plottel

[57] ABSTRACT

A picture tube designed for providing an electrical output includes a vacuum enclosure provided with a window transparent to the radiation to be converted to an electrical signal and a window transparent to a scanning light beam. The enclosure houses an assembly including a screen and a photocathode having a mosaic of picture storage elements, and an electron-emissive cathode for establishing a reference potential on the photocathode, an anode for collecting signal electrons, a field grid and electron optics. An external light source is used to provide a light beam for scanning the photocathode.

20 Claims, 7 Drawing Figures

FIG_1-a
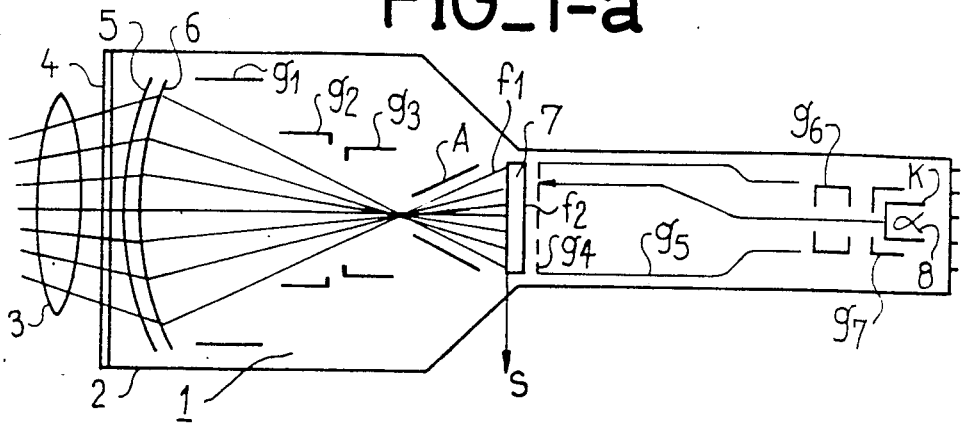
FIG_1-b
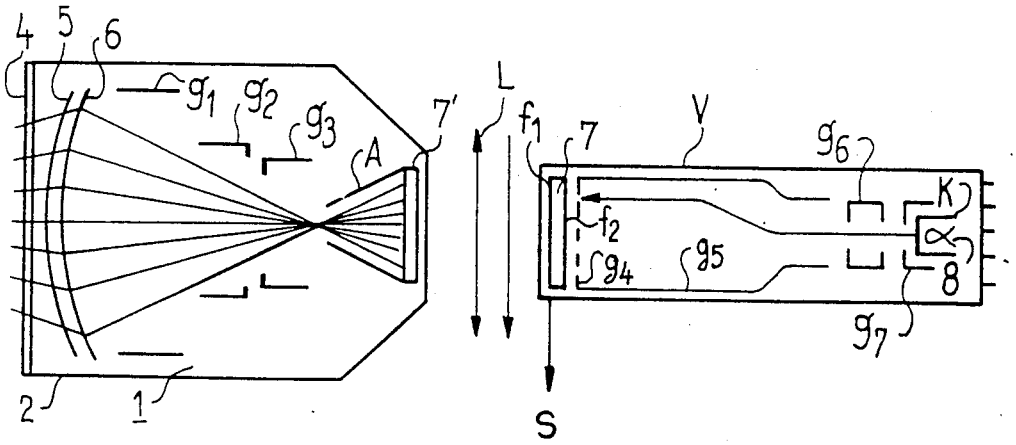

PICTURE TUBE WITH VIDEO OUTPUT, PICTURE TAKING SYSTEM UTILIZING SUCH TUBE AND OPERATING PROCESS OF SAID TUBE

BACKGROUND OF THE INVENTION

1. Field of the Invention

The present invention concerns a picture tube having a video output intended to transform the picture of an incident radiation into an electrical signal.

In the following description, reference will be made more parituclarly to picture tubes having a video output utilized in radiology, i.e. to X-ray converter or intensifier tube. It is, however, obvious for the man skilled in the art that the invention can also apply to picture tubes detecting or converting radiations from within the visible spectrum, within the invisible spectrum such as X-rays or even a neutron stream. In this case, it is necessary to change the nature of the input screen in order to adapt it to the incident radiations to be converted.

2. Description of the Prior Art

In order to fully comprehend the problem that is overcome in the present invention FIGS. 1(*a*) and 1(*b*) represent two picture systems with video outputs utilized in radiology, namely a radiology picture intensifier tube having a video output and a system constituted by a picture intensifier tube optically connected to a vidicon tube.

The picture intensifier tube having a video output represented in FIG. 1(*a*) designated as a whole by the reference numeral 1 comprises, from left to right of the figure, the picture intensifier tube itself along with the picture taking part that are contained in the same vacuum enclosure 2. The vacuum enclosure 2 comprises an entrance window 4 transparent to the X-ray beam that is detected after having through crossed the body 3 to be observed.

The picture intensifier tube accordingly includes within the enclosure an entry screen consisting of flash or flicker device 5 and a photocathode 6 for conversion of the incident X-rays in turn into photons and photoelectrons g1, g2 and g3 for focusing and accelerating the emitted electrons towards the conical anode A. The tube further includes a target screen 7 one surface f1 of which receives the electrons emitted by photocathode 6 and the other surface f2 of which is scanned by an electron beam provided by thermoemissive cathode K heated by filament 8 and focused and accelerated by grids g4, g5, g6 and g7.

Output video signal S is, in this case, collected on the face $f_1$ of the target 7.

The system represented in FIG. 1(*b*) comprises a picture intensifier tube T, an optical coupling system L and a vidicon tube V. The picture intensifier tube T is identical to the picture intensifier tube part represented in FIG. 1(*a*). The sole difference between these two parts lies in the fact that the picture intensifier tube T of figure 1(*b*) comprises an electroluminescent screen 7' upon which is formed the visible picture of the observed body. Similarly, the vidicon tube V is similar to the picture taking part of the tube represented in FIG. 1(*a*) and will therefore not be again described in detail, the same elements bearing identical references in both figures.

The main drawback of these two picture taking systems when they are utilized especially in radiology is their bulkiness, particularly for large picture field tubes. Indeed, in picture intensifier tubes, electronoptics do not allow very wise angular openings without a deterioration in the quality of the picture. This situation leads to selecting length/picture field ratios higher than 1.3:1. Similarly, in vidicon tubes, for electronoptics reasons, the length/picture field ratio is higher than 4:1. Consequently, the greater the picture image, the greater the depth of the system, even when, in the case of the system represented in FIG. 1(*b*), the optical coupling system L allows to place the vidicon tube V perpendicular to the picture intensifier tube T. By way of example, a useful field of $40\times40$ cm$^2$ leads to a depth, for a traditional picture intensifier tube, higher than 75 cm.

Consequently, if it is required to produce a picture taking system having a wide field and low bulk in depth, it is necessary to utilize concepts different to those already utilized in the prior art.

SUMMARY OF THE INVENTION

The present invention therefore concerns a novel picture tube with video output presenting a length/picture field ratio lower than that of known tubes.

In accordance with an embodiment of the present invention, a picture tube designed to convert a picture scene into an electrical output signal comprises a vacuum enclosure provided with an entrance window for the picture scene and an entrance window for a scanning light beam. The enclosure houses a screen-photocathode assembly on which is incident light from the picture scene to be converted into a photoelectron stream which is formed into a beam by electron optics for collection by an anode. The enclosure also houses a second cathode for providing a stream of electrons for incidence on the mentioned photocathode for restoring it to a desired reference potential when desired. An external light source provides the scanning light beam which is used to scan the photocathode for setting its maximum potential by stimulating the emission of signal electrons.

In this case, electrooptics do not act to form the picture of the photoelectrons issuing from the photocathode on a screen. It is therefore possible to produce it in a very compact form, thereby allowing to decrease the length/picture field ratio.

The present invention also concerns a picture taking system comprising, associated to a picture tube with video output such as described herein-above, a luminous source emitting a luminous beam, a scanning or sweeping system ensuring the deflection of the luminous beam without loss of focussing over the whole surface of the photocathode and, possibly, an optical relay system directing the luminous beam towards the photocathode, constituted either by a optical system of the wide angular type forming the picture of an intermediary dispersing plane or by juxtapositioned microlenses.

The present invention also concerns an operating process for a picture tube with video output comprising a data-entering and memorization phase, a reading phase and a reset to zero phase, wherein:

during the data-entering and memorization phase, under irradiation by the incident radiation, the screen-photocathode assembly detects or converts the incident radiation and emits a stream of photoelectrons collected by the anode(s), thereby modifying the potential of the different points of the photocathode;

during the reading phase, the different points of the photocathode are scanned by using a luminous beam, so that the potential of said points is brought back to the maximal potential given by the field grid and the current of the signal obtained by this photo-excitation is collected, then during the reset to zero phase, the photocathode is bombarded by a stream of electrons or photoelectrons in order to bring the potential of the photocathode to a potential reference.

BRIEF DESCRIPTION OF THE DRAWING

Other objects, advantages and features of the present invention will become apparent from reading the following description of different embodiments, given with reference to the appended drawing in which:

FIG. 1(*a*) already described herein-above, is a schematic representation of a picture intensifier tube with video output according to the prior art;

FIG. 1(*b*) already described herein-above, is a schematic representation of a system comprising a picture intensifier tube optically coupled to a vidicon tube;

On the different figures, the same references designate the same elements. Furthermore, for enhanced clarity, the dimensions and proportions of the various elements have not been respected.

DESCRIPTION OF THE PREFERRED EMBODIMENTS

Figure 2:
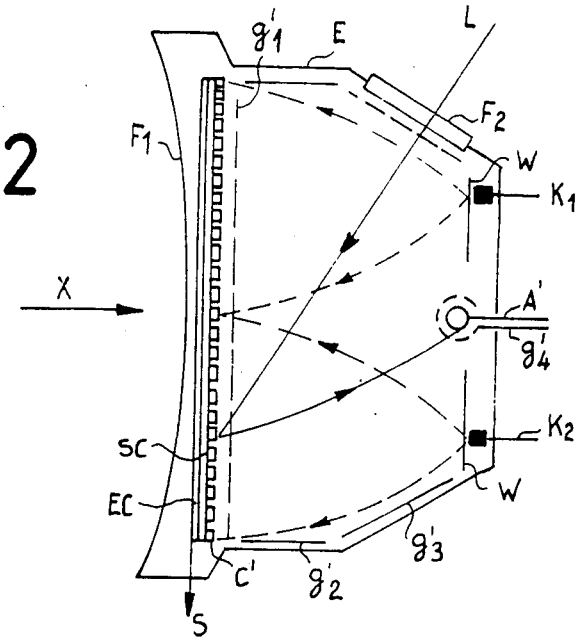
FIG. 2 is a schematic representtion of a picture tube with video output according to a first embodiment of the present invention.
Figure 3:
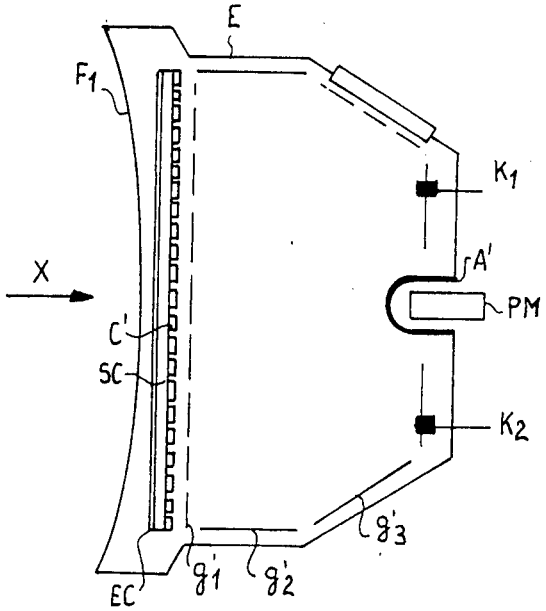
FIG. 3 is a schematic representation of a picture tube with video output according to a second embodiment of the present invention.

As represented in FIGS. 2 and 3, the picture tube with video output according to the present invention comprises a vacuum enclosure E. This enclosure is preferably made of a metal or ametallic alloy such as aluminu, stainless steel, iron-nickel alloys or iron-cobalt alloys. The enclosure E can also be made of glass. However, in this case, the glass is coated with a metallic covering in order to define the potential.

The enclosure E comprises on its face exposed to the incident radiation, namely X-rays in the case of a tube utilized in radiology, an entrance window $F_1$ transparent to the said radiation. This window is preferably made of thin glass, of titanium, of aluminum or of thin steel.

Figure 4:
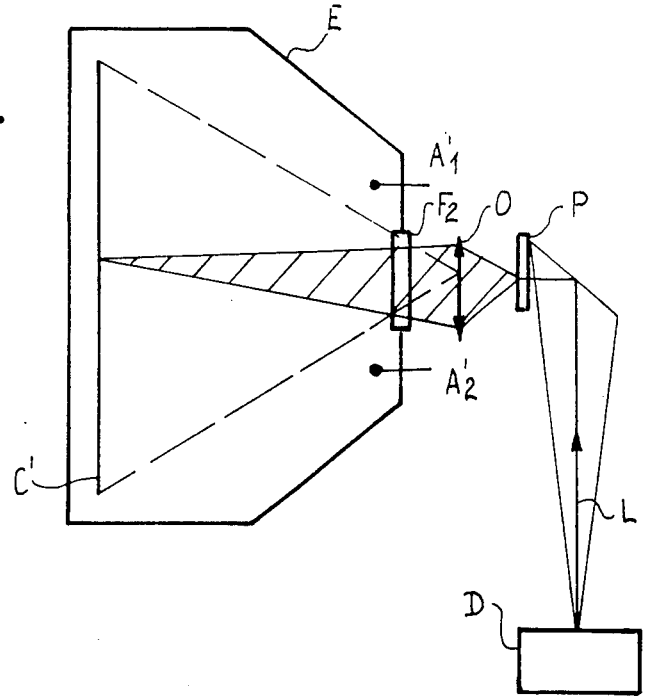
FIG. 4 is a schematic representation of a picture taking system according to the present invention.

The enclosure E also comprises in the part opposite the window $F_1$, at least one optical window $F_2$ allowing the passage of a luminous beam L. The optical window(s) $F_2$ can be laterally disposed as represented in FIGS. 2 and 3 or they can be axially disposed as represented in FIG. 4. This latter arrangement favorizes the optical scanning of the photosensitive layer or photocathode, as will be explained herein-below.

Furthermore, the dimensions of the vacuum enclosure are selected so that the length/picture field is preferably comprised between 0.5 and 1.

Disposed within the enclosure are essentially located the following elements, positioned from left to right in the figures starting from the entrance window $F_1$:

a screen-photocathode assembly SC-C';

a field grid $g'_1$;

electronoptics comprising accelertion and focussing grids $g'_2$, $g'_3$, $g'_4$ and at least one anode A' to collect the electrons; and means $K_1$, $K_2$ for emitting a stream of electrons or photoelectrons.

Figure 5:
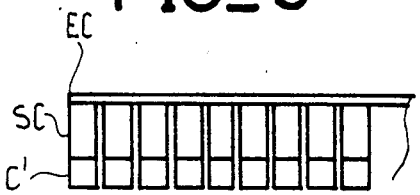
FIG. 5 is an enlarged sectional view of a screen-photocathode assembly utilized in the tube according to the present invention.

In the case of X-ray radiation, the screen-photocathode assembly is constituted essentially by a flickering device SC coated with a photo-emitting layer or photocathode C', the assembly being deposited on a conducting support electrode EC and realized in such a way as to form elementary capacities as represented in FIG. 5. The flickering device utilized can be any known flickering device intended to transform X-rays into luminous photons, such as alkaline and alkaline-earth halogenides, gadolinium oxysulphide, zinc sulphide, Ca $WO_4$. In fact, the flickering device is preferably made of cesium iodide. Indeed, it is known to dispose cesium iodide on a conducting substrate, made of aluminum for example, in the form of needles insulated from one another, thereby giving a screen of alveolar structure. The photoemitting layer is realized by any known photoemitting layer compatible with the flickering device. Thus, the photoemitting layer can be made of alkaline antimonide, for example. It is deposited on the flickering device, for example, by evaporation through a grid positioned on the flickering device, in order to obtain a structure inmosaic so as to produce elementary capacities such as represented in FIG. 5. As mentioned in the introduction of the present description, the material constituting the screen is a function of the incident radiation. It is constituted by a dielectric. Possibly, a stop layer can be provided between the flickering device and the photocathode in the case of chemical incompatibility between these two elements. This stop layer can be made of a thin layer of alumina or of silica. It is not necessary in the case of a screen made of cesium iodide and a photocathode made of antimonide.

A field grid $g'_1$ is positioned in front of the photocathode C'. Preferably, but this is not compulsory, this field grid is positioned parallely at a small distance from the photocathode C'. This field grid $g'_1$ connected to a variable external potential acts to fix the maximal potential of the photocathode C' and provokes the extraction of the photo-electrons. It is preferably made of stainless steel, of nickel, of copper or any similar material. It offers a maximal transparency to the luminous photons so as to minimize the occulting of the optical scanning beam. On the other hand, the surface of the grid can be slightly oxidized in order to reduce its optical reflectance while destroying the surface photoelectricity.

The field grid $g'_1$ is followed by an optical system comprising essentially the acceleration and focussing grids $g'_2$ and $g'_3$ and at least one anode A' possibly surrounded by a grid $g'_4$ the function of which will be explained herein-below.

The grids $g'_2$ and $g'_3$ are connected by sealed connectors (not represented) with external voltage supplies allowing to control the potential of the grids.

Different types of anode can be utilized to collect the electrons.

As represented in FIG. 2, anode A' is an anode made preferably of Cu Be, Ag Mg or Ga P. It is surrounded by a grid $g'_4$ connected to a potential that is adjustable with respect to that of the anode in order to favorize the extraction of the secondary electrons of the anode and to thus obtain a multiplier effect of the electrons.

According to another embodiment represented in FIG. 3, the anode A' consists of a metallized cathodoluminescent screen, made of metallized phosphorus having a very low persistance for example, deposited on a glass finger. This anode allows the emission of luminous photons towards a photomultiplier PM outside the enclosure.

Furthermore, the anode can also be constituted by the first dynode of an electron multiplier of a known type.

Similarly, means $K_1$, $K_2$ to send a stream of electrons or photoelectrons towards the photocathode C' are provided inside the enclosure. These means are constituted by one or several themoemissive cathodes $K_1$ and $K_2$ such as those represented in FIGS. 2 and 3. However, photoemissive cathodes can also be utilized. The thermoemissive cathodes are generally oxide cathodes with direct or indirect heating or cathodes made of thorated or not tungsten. They are surrounded by a control grid or whenelt cylinder W allowing the blocking or the release of the stream of electrons emitted by the cathode $K_1$ or $K_2$ and a certain control of the paths of the electrons upon their leaving the cathode. The photoemissive cathodes can be constituted by a combination of antimony with alkaline metals of the potassium, sodium, cesium or rubidium type.

The picture tube according to the present invention can also comprise other means normally provided in picture intensifier tubes such as means for producing a photoemissive layer of the Sb-Cs or Sb-alkalines, in particular Sb-K-Cs type. These means can be incorporated within the tube and constituted by an evaporator or materials able to be introduced through the intermediary of pumping pips.

Active and/or chemical getters can be incorporated into the tube in order to maintain a high quality vacuum.

To render simple comprehension of the annexed drawing, these means have not been represented.

As represented in FIG. 4, the picture tube with video outlet according to the present invention is associated to a luminous source emitting a luminous beam L, a scanning system D ensuring the deflection of the luminous beam without loss of focussing, over the whole surface of the photocathode C' and, possibily a relay optical system. This relay optical system is constituted by a scattering plane P, obtained, for example, through utilizing an optical fibres blade and an optics 0 of wide angular type. It is also possible to utilize juxtapositioned microlenses.

The mode of functioning of the picture tube with video output according to the present invention will now be described with particular reference to FIG. 6.

The mode of functioning comprises three distinct phases:

a phase for detecting the picture of the incident radiation and transforming into electronic picture through integration and memorization;

a reading phase of the memorized picture; and a reset to zero phase.

During the reset to zero phase, the thermoemissive cathodes $K_1$ and $K_2$ are brought to a negative potential with respect to the potential of the field grid $g'_1$, the control electrode W being released. Cathodes $K_1$ and $K_2$ thus emit electrons towards the photocathode C', the paths of which are controlled by the potential applied to the grids $g'_2$ and $g'_3$ so as to bombard orthogonally the photocathode C'. By way of example, the potential of the cathodes $K_1$, $K_2=0$ V, the potential of the field grid $g'_1$ is selected between 100 and 200 V and the potentials of the grids $g'_2$ and $g'_3$ are selected between 0 and 50 V.

Figure 6:
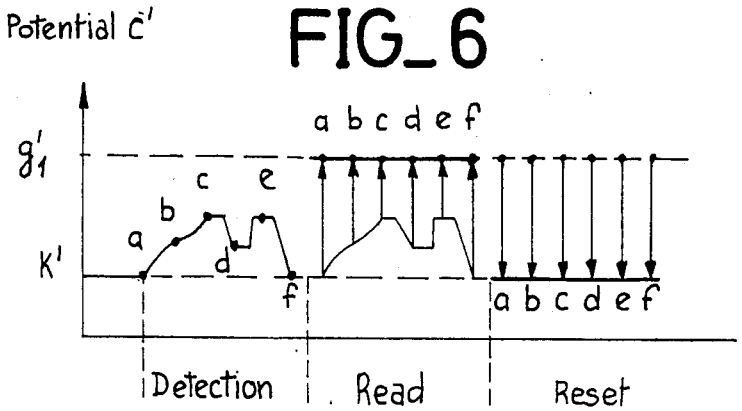
FIG. 6 is a diagram giving the potential of the different points of a photocathode line during different operating phases.

Due to the electron bombardment, the potential of the cathode tends progressively towards the potential of the cathodes $K_1$, $K_2$ such as represented on the right hand part of the diagram of FIG. 6.

During the detection phase, the body to be observed is irradiated by X-rays. The X-radiation, after having crossed through the body and the entrance window, reaches the flickering device SC that emits, under the effect of the X-rays, a stream of luminous photons that excites the photocathode C'. Under the effect of this photo-excitation, the photocathode emits photo-electrons that cross through the field grid $g'_1$ and are collected by the anode(s) A', these electrodes being brought to suitable potentials. By way of example, the potential of the field grid $g'_1=100$ V and the potential of the other electrodes $g'_2$, $g'_3$ and A is positive from 0 to 100 V.

Due to the electrons emitted towards the anode, the potential of each photocathode element varies positively in function of the charge emitted and assumes values represented by a, b, c, d, e, f, on the left-hand part of the diagram of FIG. 6. In fact, the maximal limit of the potential that each photocathode element can take is fixed by the potential of the field grid. Beyond this potential, the electrons are no longer emitted. It will be noted that this phenomenon is worth-while for limiting the dynamic of certain pictures.

After detection, the potential of the elements of the photocathode C' converts the local luminance of the incident picture according to a distribution varying from 0 to the potential of the field grid $g'_1$.

The reading phase is achieved by sequentially exploring the different points or elements of the photocathode C' through using a luminous beam L. During this operation, the anode(s) A' are brought to a positive potential that is comprised, for example, between 100 and about 1000 volts. The grids $g'_2$, $g'_3$ are at potentials varying fro $-100$ V to about 10 volts so as to optimize the paths of the photoelectrons issuing from the photocathode C' and crossing through the field grid $g'_1$.

Under the effect of the stream of luminous photons, the floating potential of the different points of the photocathode is brought to the value obtained after detection of the picture at the maximal potential imposed by the field grid $g'_1$ as represented in FIG. 6, thereby giving rise to the reading signal that is complementary to the memorized photo-signal.

The reading signal can be collected on the anode(s) A' or on the support electrode EC.

In the case of FIG. 2, the anode A' collects directly the electrons in order to supply an external video amplifier (not represented).

A multiplier effect is obtained by bringing the grid $g'_4$ to a positive potential with respect to that of the anode A', thereby allowing collection of the secondary electrons obtained through impact of the photoelectrons on the anode A'.

In the case of FIG. 3, the anode A' being constituted by a metallized cathodoluminescent screen, it emits under the impact of the photo-electrons, luminous photons that are transmitted through the glass finger forming an optical window towards the photomultiplier PM that delivers the signal current.

In the case of FIG. 4, the electrons collected directly on the two anodes $A_1$ and $A_2$ as in the embodiment represented in FIG. 2, are added together in order to give the total signal current.

In any case, the signal can also be drawn off the support electrode EC connected to a video amplifier. In this case, in order to improve the signal/noise ratio, the support electrode can be divided into several electrodes each connected to a video amplifier.

The picture tube with video output according to the invention offers numerous advantages with respect to tubes presently known.

Therefore, the structure described allows to produce a picture tube with video output that is extremely compact with a length/picture field ratio able to reach 0.5.

The method of functioning without focussed electronic picture formation allows to obtain rectangular formats, such formats being better adapted to radiological applications.

The optical scanning that allows to give rise to the obtention of the video signal can be achieved with the use of relatively inexpensive luminous sources that requires little space, such as laser sources or diodes having a power lower than 10 mW.

the tube presents a dynamic that is adjustable by controlling the voltage of the field grid $g'_1$, thereby allowing its functioning either in radioscopy or in radiology when it is utilized for radiological applications.

I claim:

1. A picture tube with video output for transforming incident radiation into an electrical signal comprising a vacuum enclosure including an entrance window transparent to the radiation and an entrance window transparent to a light beam, an assembly including a screen and a photocathode forming a mosaic of picture storage elements positioned to intercept the radiation passing into the enclosure for converting it into a stream of emitted electrons and for storing the pattern of the incident radiation, means for setting the maximum potential of the photocathode and for provoking the emission of the electrons, means for establishing a reference potential on the photocathode by electron bombardment, means for providing a light beam for scanning the photocathode and for establishing said maximum potential on the photocathode by the photoemission of electrons, and means for collecting the video output signal formed during the scanning of the photocathode, and electron optics for controlling the flow of the different streams of electrons.

2. Picture tube with video output, according to claim 1, wherein the screen is constituted by a dielectric.

3. Picture tube with video output according to claim 1, wherein the screen comprises flickering means for transforming the incident radiation into luminous photons.

4. Picture tube with video output according to claim 3, wherein the flickering means is selected from among zinc sulphide, gadolinium oxysulphide, $CaWO_4$, and the alkaline or alkaline-earth halogenides such as cesium iodide.

5. Picture tube with video output according to claim 1, wherein the flickering means is deposited on a conducting electrode transparent to the incident radiation.

6. Picture tube with video ouput, according to claim 1, wherein the means for establishing the reference potential on the photocathode, comprises at least one thermoemissive cathode.

7. Picture tube with video output according to claim 6, wherein the thermoemissive cathode is surrounded by a control grid allowing the blocking or the release of the electrons emitted.

8. Picture tube with video output according to claim 1, wherein the electrooptics comprise at least one anode in order to collect the stream of electrons or issuing from the photocathode and at least one grid in order to direct the different streams of electrons.

9. Picture tube with video output according to claim 1, wherein the means for collecting the electrical signal obtained during scanning by the luminous beam comprises anode means.

10. Picture tube with video output according to claim 9, wherein the anode means is associated with an electron multiplier device.

11. Picture tube with video output according to claim 10, wherein the electron multiplier device comprises a grid surrounding the anode means which can be brought to a positive potential with respect to said anode.

12. Picture tube with video according to claim 11, wherein the anode is made of Cu Be, Ag Mg or Ga P.

13. Picture tube with video output according to claim 10, wherein the anode comprises a metallized cathodoluminescent layer deposited on a glass finger and wherein it is associated with an external photomultiplier.

14. Picture tube with video output according to claim 1, wherein the means for collecting the electrical signal formed during scanning comprises a support electrode.

15. Picture taking system for transforming the picture of an incident radiation into an electrical signal comprising a picture tube with video output according to claim 1 and further comprising a source of luminous rays and a scanning device ensuring the deflection of the luminous beam without significant loss of focussing over the whole surface of the photocathode.

16. Picture taking system according to claim 15, further comprising relay optics directing the luminous beam towards the photocathode.

17. Picture taking system according to claim 16, wherein the relay optics comprises an intermediary scattering plane and a wide angular type optics forming the picture of the said plane.

18. Picture taking system according to claim 16, wherein the relay optics comprieses juxtapositioned microlenses.

19. A picture tube according to claim 1 in which the means for establishing the reference potential on the photocathode comprises at least one photoemissive cathode.

20. The process of operating a picture tube with video output for transforming incident radiation into an electrical signal comprising a vacuum enclosure including an entrance window transparent to the radiation and an entrance window transparent to a light beam, an assembly including a screen and a photocathode forming a mosaic of picture storage elements positioned to intercept the radiation passing into the enclosure for converting it into a stream of emitted electrons and for storing the pattern of the incident radiation, means for setting the maximum potential of the photocathode and for provoking the emission of the electrons, means for establishing a reference potential on the photocathode by electron bombardment, means for providing a light beam for scanning the photocathode and for establishing said maximum potential on the photocathode by the photoemission of electrons, and comprising irradicating the assembly of screen and photocathode with the radiation to be detected for converting the incident radiation and establishing a potential pattern on the photocathode corresponding to the radiation pattern by the photoemission of electrons, scanning the photocathode with a light beam to restore the photocathode to the maximum potential and causing the photoemission of electrons for creating the video output signal, and bombarding the photocathode with electrons to establish the reference potential on the photocathode for resetting.

* * * * *